US010260828B2

(12) United States Patent
Harrigan et al.

(10) Patent No.: US 10,260,828 B2
(45) Date of Patent: Apr. 16, 2019

(54) RECEIVER ASSEMBLY FOR LOCKED BREECH PISTOL

(71) Applicant: ZRODELTA, LLC, Connelly Springs, NC (US)

(72) Inventors: Patrick L. Harrigan, Fayetteville, NC (US); Joel Edwards, Valdese, NC (US); Johnathan Charles Birk, Lubbock, TX (US); Timothy Wayne Raley, Lubbock, TX (US)

(73) Assignee: ZRODELTA, LLC, Connelly Springs, NC (US)

( * ) Notice: Subject to any disclaimer, the term of this patent is extended or adjusted under 35 U.S.C. 154(b) by 0 days.

(21) Appl. No.: 15/678,483

(22) Filed: Aug. 16, 2017

(65) Prior Publication Data

US 2019/0056187 A1 Feb. 21, 2019

(51) Int. Cl.

| | |
|---|---|
| ***F41A 21/48*** | (2006.01) |
| ***F41A 3/66*** | (2006.01) |
| ***F41A 3/86*** | (2006.01) |
| ***F41A 5/02*** | (2006.01) |
| ***F41A 19/10*** | (2006.01) |
| ***F41A 35/02*** | (2006.01) |

(52) U.S. Cl.

CPC *F41A 3/66* (2013.01); *F41A 3/86* (2013.01); *F41A 5/02* (2013.01); *F41A 19/10* (2013.01); *F41A 35/02* (2013.01)

(58) Field of Classification Search

CPC .... F41A 3/66; F41A 3/64; F41A 35/02; F41C 23/16; F41C 23/06

USPC ..... 42/12, 18, 7

See application file for complete search history.

(56) References Cited

U.S. PATENT DOCUMENTS

| | | | | |
|---|---|---|---|---|
| 4,893,546 | A | 1/1990 | Glock | |
| 8,528,243 | B1 | 9/2013 | Glock | |
| 2002/0116857 | A1* | 8/2002 | Wonisch | F41A 3/64 42/75.02 |
| 2008/0060247 | A1* | 3/2008 | Thomele | F41A 3/66 42/71.02 |
| 2014/0007479 | A1 | 1/2014 | Glock | |
| 2018/0202737 | A1* | 7/2018 | Ferguson | F41C 23/10 |
| 2018/0266778 | A1* | 9/2018 | Noonan | F41A 3/66 |

OTHER PUBLICATIONS

US 9,644,908 B2, 05/2017, Gomez (withdrawn)

"Glock." Wikipedia, Jun. 25, 2017, https://en.wikipedia.org/wiki/Glock. Accessed Jun. 30, 2017.

* cited by examiner

*Primary Examiner* — J. Woodrow Eldred

(74) *Attorney, Agent, or Firm* — Bennet K. Langlotz; Langlotz Patent & Trademark Works, LLC

(57) ABSTRACT

The present invention is a semi-automatic pistol receiver assembly comprising multiple removable parts rather than single piece construction normally used in semi-automatic pistols.

10 Claims, 4 Drawing Sheets

RECEIVER ASSEMBLY FOR LOCKED BREECH PISTOL

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates a pistol receiver assembly. In particular, it relates to a receiver assembly for a semi-automatic pistol.

Description of Related Art

The introduction of the semi-automatic pistol having a short recoil locked breech (hereinafter semi-automatic pistol) by Glock revolutionized the pistol market for semi-automatic weaponry. While the slide, barrel, and recoil spring are made of steel, the remaining receiver assembly is a one-piece device. About 90% of the receiver assembly is plastic. The receiver assembly is manufactured as a single-piece assembly. If you wish to have a different part of the receiver assembly, it is necessary to replace the entire assembly.

In addition, while the lightweight nature of plastic adds some advantages, as the gun heats up during use, the differences in expansion coefficients for steel versus plastic have been known to cause some problems. In addition, if a portion of the assembly is damaged, once again, the entire assembly must be replaced. At this point, however, no one has determined how to design a multiple piece receiver assembly which overcomes the problems associated with the current technology for semi-automatic pistols.

BRIEF SUMMARY OF THE INVENTION

The current invention relates to a semi-automatic pistol assembly wherein there are multiple pieces that fit together to form a receiver assembly. Because of the nature of the design, the assembly can be plastic, as in previous models, but can also be entirely of metal which not only allows for solving the problems noted above but allows for further customizing of the receiver assembly without having to have a new assembly for each modification.

Accordingly, in one embodiment, there is a semi-automatic pistol receiver assembly comprising:

a) a sub-receiver having a device for receiving a barrel and slide assembly of a semi-automatic pistol wherein the sub-receiver has a front end device for removably attaching to a front dust cover and a back end device for removably attaching to a pistol grip frame;
b) a front dust cover;
c) a pistol grip frame; and
d) at least one of a front and rear grip strap.

In another embodiment, there is a semi-automatic pistol sub-receiver comprising a device for receiving a barrel and slide assembly of a semi-automatic pistol wherein the sub-receiver has a front end device for removably attaching to a front dust cover and a back end device for removably attaching to a pistol grip frame.

In yet another embodiment, there is a semi-automatic pistol receiver kit and parts comprising:

a) a sub-receiver having a device for receiving a barrel and slide assembly of a semi-automatic pistol wherein the sub-receiver has a front end device for removably attaching to a front dust cover and a back end device for removably attaching to a pistol grip frame;
b) a front dust cover;
c) a pistol grip frame; and
d) at least one of a front and rear grip strap.

DETAILED DESCRIPTION OF THE INVENTION

Figure 1A:
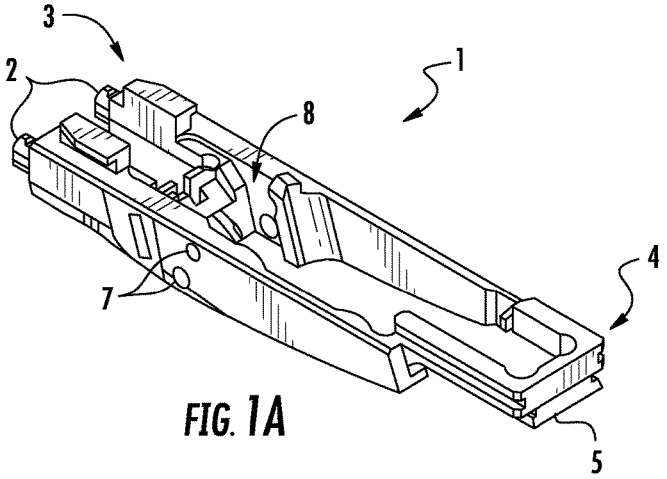
FIGS. 1*a* and 1*b* are perspective views of the sub-receiver.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals, if any, are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps or acts are in some way inherently mutually exclusive.

The drawings featured in the figures, if any, are for the purpose of illustrating certain convenient embodiments of the present invention, and are not to be considered as limitation thereto. The term "means" preceding a present participle of an operation indicates a desired function for which there are one or more embodiments, i.e., one or more methods, devices, or apparatuses for achieving the desired function and that one skilled in the art could select from these or their equivalent in view of the disclosure herein and use of the term "means" is not intended to be limiting.

As used herein, the term "semi-automatic pistol" refers to a semi-automatic pistol having a short recoil locked breech. These are the pistols generally referred to in the trade as Glock pistols or Glock safe "Action®" pistols. These are various caliber bullet type pistols which, in the prior art, have a one-piece metal and plastic receiver assembly. As used herein, the term "semi-automatic receiver assembly" refers to a collection or kit of parts comprising a sub receiver, a front dust cover, a pistol grip frame, and at least one of a front and rear grip strap which assemble into a receiver for accepting a trigger assembly, a slide, a barrel, a recoil spring assembly, a bullet magazine tube, and a magazine well funnel.

As used herein, the term "sub receiver" refers to a piece of the whole receiver that is designed to receive the barrel and the slide with the recoil spring attached. In the original Glock, this is just a molded area and not a separate piece. The front of the sub receiver has a device for removably attaching a front dust cover. In the embodiment shown in the Figures, there are two cylindrical locking posts. These each have a spring loaded ball bearing and front with two holes in the front dust cover to assemble the pieces together.

As used herein, the term "front dust cover" refers to a piece, as shown in the Figures, which attaches to the front of the subreceiver. It is a protective cover positioned below the barrel to protect the exposed bottom portion of the barrel on the pistol, the top portion covered by the slide assembly. In one embodiment, there are two holes on the back side for mounting/connecting to the receiver sub-assembly, as shown in the figures.

As used herein the term "pistol grip frame" refers to the portion of the pistol, as shown in the Figures, which includes the trigger guard, the trigger mounting, the handle to hold the pistol, trigger guard, and a space to insert the magazine tube assembly.

As used herein the term "grip strap" refers to a detachable front and back piece which, as shown in the Figures, mounts to the front and back of the handle on the pistol grip frame in order to change the size of the grip handle for different size hands. The connection can be by any means. In one embodiment, it is a removable attachment, for example by screws, clips, or the like.

As used herein, the term "magazine well funnel" refers to a device at the end of the space to insert the magazine tube assembly which widens the opening in a funnel fashion to make it easier to insert a magazine with bullets into the magazine well.

As used herein, the term "trigger assembly" refers to the mechanism in a semi-automatic pistol that comprises the trigger and the mechanism used to transfer the trigger movement to firing a bullet. A representative example of such mechanism is shown in the Figures and mounts on the pistol grip frame.

As used herein, the term "slide" refers to the standard slide used with semi-automatic pistols and is well known in the art.

As used herein, the term "barrel" refers to a standard barrel used with semi-automatic pistols and is well known in the art.

As used herein, the term "recoil spring assembly" refers to the standard recoil spring used in semi-automatic pistols and is well known in the art.

As used herein, the term "magazine tube assembly" refers to the magazine that holds bullets, e.g. 9 mm bullets, that is inserted into the grip frame handle for delivering bullets during use. The standard semi-automatic pistol magazine is intended.

DRAWINGS

Figure 1B:
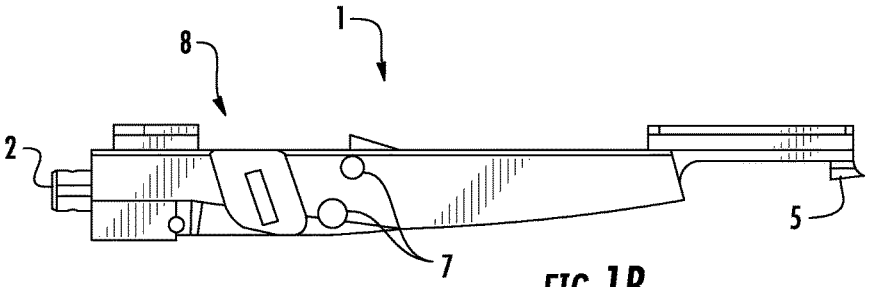

Now referring to the drawings, FIG. 1*a* is a perspective view of the receiver sub-assembly 1 of the present invention. In this view, there are two locking posts 2 in the front 3 of the sub-assembly 1 for mounting the front dust cover. In the back 4 of the sub-assembly, there is a slide clip 5 for mounting to the pistol grip frame. For additional mounting to the grip frame are pin holes 7 which mate with holes on the pistol grip frame. The internal mechanism 8 is designed to hold the barrel and receiver in the manner known in the art. FIG. 1*b* is a side view of the sub-assembly 1.

Figure 2:
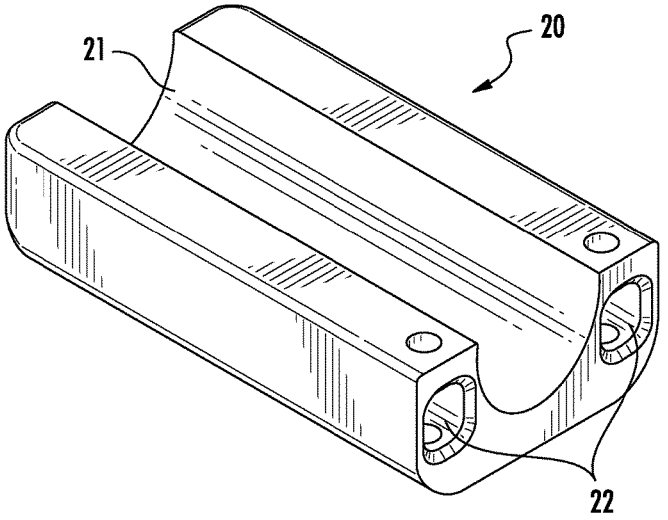
FIG. 2 is a perspective view of the front dust cover.

FIG. 2 is a front dust cover 20 having channel 21 for clearance of the recoil spring and mounting holes 22 for receiving the posts of the sub-assembly and connecting the two.

Figure 3:
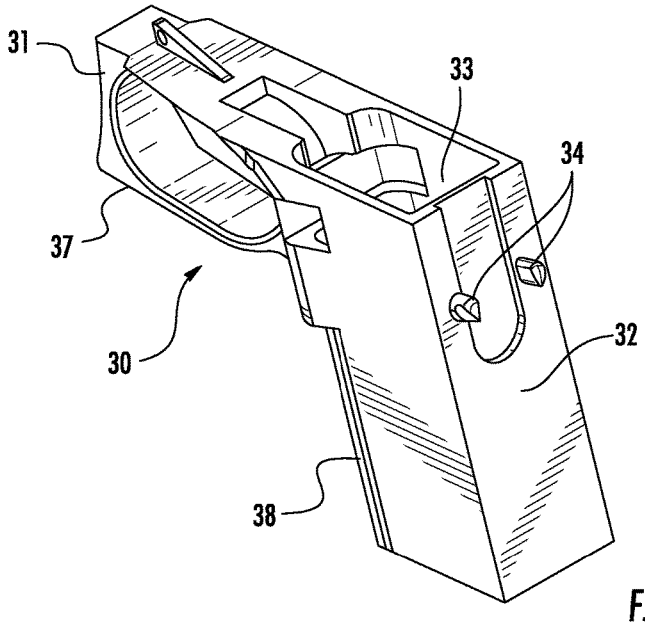
FIG. 3 is a perspective view of the pistol grip frame.

FIG. 3 is a perspective view of the pistol grip frame 30 where the receiver mounts to the grip frame 30 at front 31. The grip frame 30 has handle 32 for receiving a magazine in a well 33 and mounting lugs 34 for receiving a back grip strap. A front grip strap 38 is already attached to the front of handle 32. It is designed to receive a trigger assembly and position a trigger in trigger guard 37.

Figure 4:
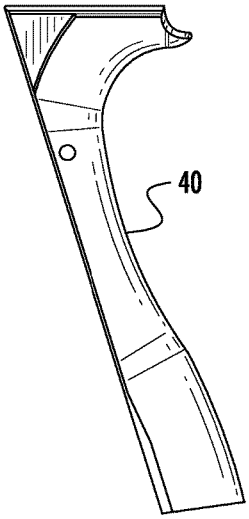
FIG. 4 is a perspective view of the grip back strap.

FIG. 4 is a side view of a grip back strap 40 which mounts on the mounting nuts 34 of the pistol grip frame handle 32, shown in FIG. 3.

Figure 5:
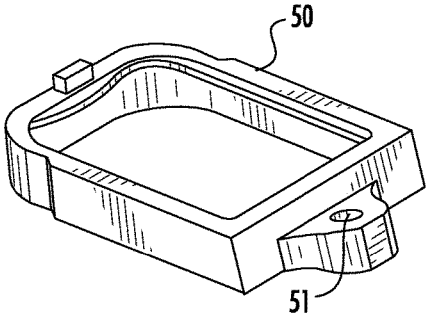
FIG. 5 is a perspective view of the magazine well funnel.
Figure 9:
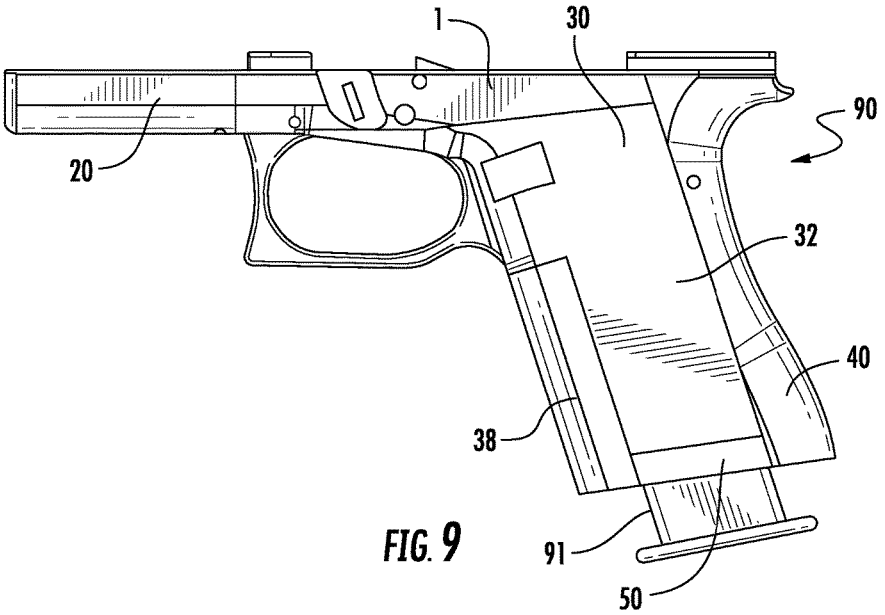
FIG. 9 is a side view of the assembled receiver assembly of the invention.

FIG. 5 is a magazine well funnel 50 which mounts on the bottom of the pistol grip frame handle for making it easier to insert a magazine quickly by increasing the size of the initial opening. Mounting is shown in FIG. 9. In this view, screws are used with mounting holes 51 to attach the well funnel 50.

Figure 6:
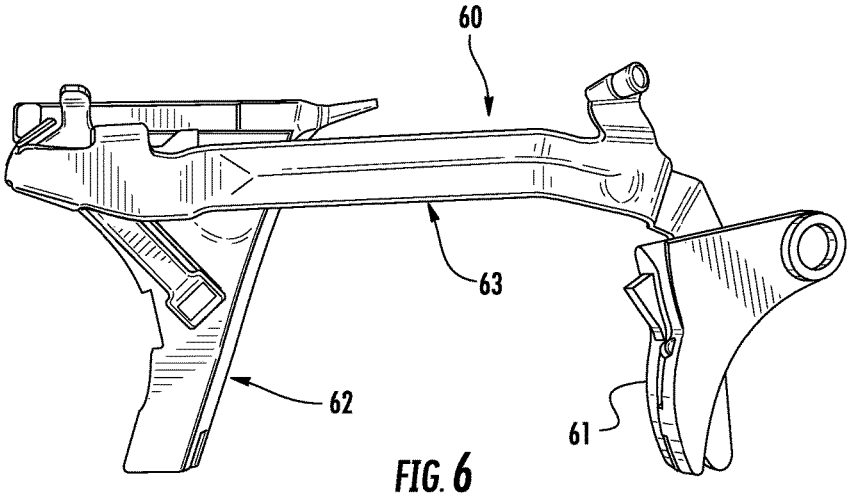
FIG. 6 is a perspective view of the trigger assembly.

FIG. 6 shows a typical trigger assembly 60. In this view, we see trigger 61, connector 62, and trigger bar 63 which is inserted into the pistol grip frame in the normal manner known in the art.

Figure 7:
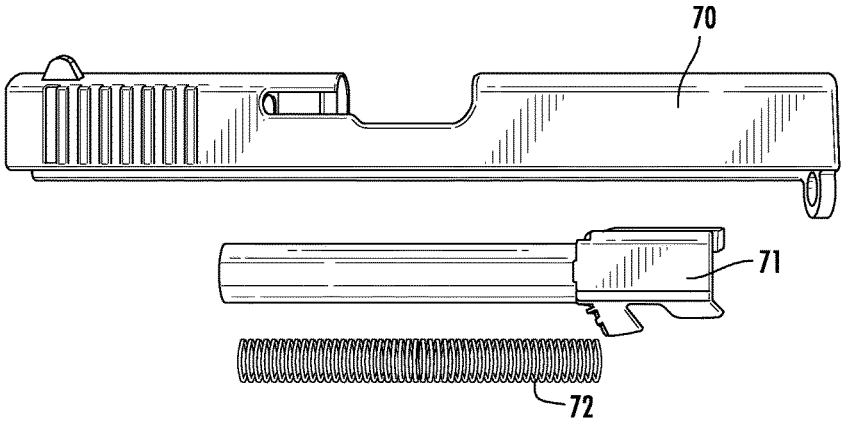
FIG. 7 is a side view of a slide, barrel, and recoil spring.

FIG. 7 shows a side view of the typical slide 70, barrel 71, and recoil spring 72 which is used in a semi-automatic pistol. These items are within the skill of the art and the present invention, as noted above, is designed to receive these items.

Figure 8:
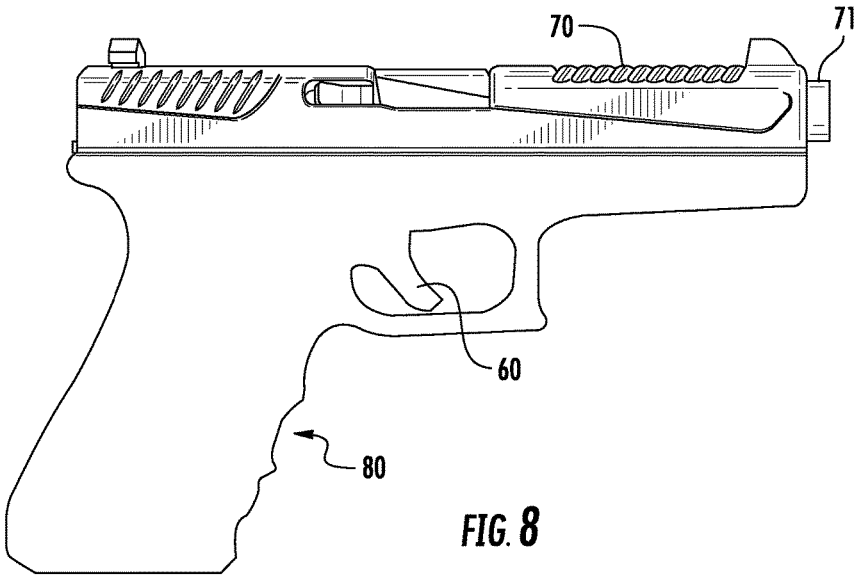
FIG. 8 is a side view of the trigger, slide barrel, and recoil spring mounted on the assembly of the present invention.

FIG. 8 shows the assembled slide 70 with the barrel 71 and spring (hidden from view) and trigger assembly 60 on an assembled receiver assembly of the invention 80.

FIG. 9 is the assembled semi-automatic pistol receiver 90 of the invention. In this view, bullet magazine 91 is shown being inserted into the receiver assembly 90. The parts from the previous figures are numbered here to show their position in the assembled product.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A semi-automatic pistol receiver assembly comprising:

a) a sub-receiver having a device for receiving a barrel and slide assembly of a semi-automatic pistol wherein the sub-receiver has a front end device for removably attaching to a front dust cover and a back end device for removably attaching to a pistol grip frame;

b) a front dust cover;

c) a pistol grip frame; and d) at least one of a front and rear grip strap.

2. The pistol receiver assembly according to claim 1 which further comprises a magazine well funnel.

3. The pistol receiver according to claim 1 which further comprises a trigger assembly.

4. The pistol receiver assembly according to claim 1 which further comprises a trigger assembly, a slide, a barrel, and recoil spring assembly.

5. The pistol receiver according to claim 1 which further comprises a bullet magazine tube.

6. A sub-receiver according to claim 1 wherein the device for attaching the front dust cover to the receiver is a pair of locking posts.

7. The sub-receiver according to claim 6 wherein the device for removably attaching to the pistol grip frame is a slide clip.

8. A semi-automatic pistol sub-receiver comprising a device for receiving a barrel and slide assembly of a semi-automatic pistol wherein the sub-receiver has a front end device for removably attaching to a front dust cover and a back end device for removably attaching to a pistol grip frame.

9. A sub-receiver according to claim 8 wherein the device for attaching the front dust cover to the receiver is a pair of locking posts.

10. A semi-automatic pistol receiver kit and parts comprising:

a) a sub-receiver having a device for receiving a barrel and slide assembly of a semi-automatic pistol wherein the sub-receiver has a front end device for removably attaching to a front dust cover and a back end device for removably attaching to a pistol grip frame;

b) a front dust cover;

c) a pistol grip frame; and d) at least one of a front and rear grip strap.

* * * * *